US010604978B2

(12) United States Patent
Wu

(10) Patent No.: US 10,604,978 B2
(45) Date of Patent: Mar. 31, 2020

(54) ADJUSTABLE-ANGULAR POSITIONING AND SELF-CLOSING HINGES

(71) Applicant: TONGGUAN (XIAMEN) ELECTRONIC TECHNOLOGY CO., LTD., Xiamen, Fujian (CN)

(72) Inventor: Yulong Wu, Xiamen (CN)

(73) Assignee: TONGGUAN (XIAMEN) ELECTRONIC TECHNOLOGY CO., LTD. (CN)

( * ) Notice: Subject to any disclaimer, the term of this patent is extended or adjusted under 35 U.S.C. 154(b) by 0 days.

(21) Appl. No.: 15/763,748

(22) PCT Filed: Sep. 28, 2016

(86) PCT No.: PCT/CN2016/100554
§ 371 (c)(1),
(2) Date: Mar. 27, 2018

(87) PCT Pub. No.: WO2017/054727
PCT Pub. Date: Apr. 6, 2017

(65) Prior Publication Data

US 2018/0283067 A1 Oct. 4, 2018

(30) Foreign Application Priority Data

Sep. 29, 2015 (CN) ..... 2015 1 0631766
Sep. 29, 2015 (CN) ..... 2015 2 0762076 U
Aug. 31, 2016 (CN) ..... 2016 1 0795626

(51) Int. Cl.
*E05D 7/00* (2006.01)
*E05F 1/12* (2006.01)
(Continued)

(52) U.S. Cl.
CPC ..... *E05D 7/0027* (2013.01); *E05D 11/1014* (2013.01); *E05D 11/1078* (2013.01);
(Continued)

(58) Field of Classification Search
CPC ... E05D 7/0027; E05D 11/10; E05D 11/1064; E05F 1/06; E05F 1/1223; E05F 1/068
See application file for complete search history.

(56) References Cited

U.S. PATENT DOCUMENTS 2,779,966 A * 2/1957 Torchia ..... E05D 7/0027 16/244
3,975,794 A * 8/1976 Kaiser ..... E05F 1/063 16/303

(Continued)

FOREIGN PATENT DOCUMENTS

CN 102425348 A 4/2012
CN 202441166 U 9/2012
CN 203716713 U 7/2014

*Primary Examiner* — Jeffrey O'Brien
(74) *Attorney, Agent, or Firm* — PROI Intellectual Property US

(57) ABSTRACT

An adjustable-angle positioning and self-closing hinge has two hinge leaves, a fixing pin, a screw knuckle, a screw ring, a fixing base, and an adjusting base; each leaf of the hinge comprises a knuckle and a leaf fastened outside the knuckle; the fixing pin has a threaded pin; the screw knuckle is fastened inside the knuckle of one of the hinge leaves, the fixing base is fastened inside the knuckle of one of the hinge leaves, and the screw knuckle and the fixing base are spaced separately; between the screw knuckle and fixing base in the knuckles of the two hinge leaves are disposed the fixing pin, the screw ring, two magnets, springs, and the adjusting base; the threaded pin of the fixing pin is screwed to the screw knuckle; a first spring abuts between the fixing pin and the front ring edge and gasket of a cup body.

4 Claims, 12 Drawing Sheets

(51) Int. Cl.
*E05D 11/10* (2006.01)
*E05D 3/02* (2006.01)

(52) U.S. Cl.
CPC ..... *E05F 1/1223* (2013.01); *E05D 3/02* (2013.01); *E05D 2003/027* (2013.01); *E05Y 2201/46* (2013.01); *E05Y 2201/696* (2013.01); *E05Y 2600/10* (2013.01); *E05Y 2900/132* (2013.01)

(56) References Cited

U.S. PATENT DOCUMENTS 4,829,628 A * 5/1989 Vuksic ..... E05F 3/20 16/299
4,991,259 A * 2/1991 Finkelstein ..... E05F 1/063 16/312
5,138,743 A * 8/1992 Hoffman ..... E05F 1/1223 16/303
5,682,644 A * 11/1997 Bohacik ..... E05F 1/061 16/284
5,720,082 A * 2/1998 Rossmo ..... E05B 15/0006 16/244
6,854,161 B2 * 2/2005 Lee ..... E05F 1/1223 16/50
7,151,226 B2 * 12/2006 Minami ..... G06F 1/1616 174/161 R
8,387,210 B2 * 3/2013 Sawa ..... E05F 1/1223 16/310
8,893,352 B2 * 11/2014 Hasler ..... E05D 7/0027 16/238
8,898,860 B2 * 12/2014 Bacchetti ..... E05F 1/1223 16/50
9,353,563 B2 * 5/2016 Bacchetti ..... E05F 1/1223
9,353,564 B2 * 5/2016 Bacchetti ..... E05F 1/1223
9,605,462 B2 * 3/2017 Bacchetti ..... E05F 1/1223
9,689,185 B2 * 6/2017 McInnis ..... E05D 3/022
9,695,622 B2 * 7/2017 Bongiovanni ..... E05F 1/065
9,856,686 B2 * 1/2018 Bacchetti ..... E05F 1/1223
2006/0032021 A1 * 2/2006 Fukuo ..... E05D 7/1011 16/298
2008/0104798 A1 * 5/2008 Hoppe ..... E05D 7/0027 16/236
2008/0104799 A1 * 5/2008 Hoppe ..... E05D 7/0027 16/238
2008/0235910 A1 * 10/2008 Umback ..... E05D 5/121 16/382
2011/0191981 A1 8/2011 Bell
2015/0345203 A1 * 12/2015 Vanini ..... E05D 3/02 16/53
2016/0017648 A1 * 1/2016 Petrelli ..... E05D 7/08 16/284
2016/0083993 A1 * 3/2016 Grewe ..... E05F 1/1223 16/291
2018/0106087 A1 * 4/2018 Bacchetti ..... E05F 1/1223
2018/0258674 A1 * 9/2018 Hasler ..... E05D 7/0027
2018/0291663 A1 * 10/2018 Wu ..... E05F 1/066
2018/0363347 A1 * 12/2018 Chang ..... E05D 5/12
2019/0040667 A1 * 2/2019 Feng ..... E05F 3/20

* cited by examiner

ADJUSTABLE-ANGULAR POSITIONING AND SELF-CLOSING HINGES

TECHNICAL FIELD

The invention relates to an adjustable-angle positioning and self-closing hinge.

BACKGROUND

The Chinese patent database has announced the invention of the utility model named "A Lifting Hinge Device", Patent No. 2013208356551. It comprises an upper hinge, a lower hinge, a transmission base and a transmission pin. The upper hinge comprises an upper knuckle and an upper hinged leaf fixedly connected to the knuckle; the lower hinge comprises a lower knuckle and a lower leaf fixedly attached to the lower knuckle; the transmission base is fixedly connected to the upper knuckle; the bottom surface of the transmission base is provided with a transmission chamber in a concave way, and a first spiral portion is provided on the inner rotary surface of the transmission chamber. The transmission pin is fixedly connected to the lower knuckle, and a second spiral portion is arranged on the outer rotary surface of the transmission pin. The transmission pin connects the transmission chamber. The first spiral portion and the second spiral portion are fit to mesh, wherein: the upper hinge is pushed so that the upper hinge rotates relative to the lower hinge, and the upper hinge is raised by the cooperation of the first spiral portion and the second spiral portion. When the push is released the upper hinge is lowered under gravity, and the upper hinge is automatically reset to return closed by the cooperation of the first spiral portion and the second spiral portion. The lifting hinge device cannot be self-positioned within a predetermined angle; although it can be self-closing at another predetermined angle, it cannot adjust the predetermined angle of self-positioning.

SUMMARY

The present invention provides a self-closing hinge capable of adjusting the positioning angle of a leaf of the hinge, which overcomes the deficiencies of the lifting hinge device in the background art.

The technical solution adopted by the present invention to solve the technical problems is as follows:

An adjustable-angle positioning and self-closing hinge, comprising: two hinge leaves; a fixing pin; and a screw knuckle; the two hinge leaves being pivotable in relation to each other, each of the hinge leaves comprising a knuckle and a leaf fixed on an outside of the knuckle, the fixing pin having a screw pin, wherein the adjustable-angle positioning and self-closing hinge further comprises a fixing base, an adjusting base and a screw ring; the screw knuckle is fixed in the knuckle of one of the hinge leaves, the fixing base is fixed in the knuckle of the hinge, and the screw knuckle is separate from the fixing base; a fixing pin, a screw ring, a first magnet, a second magnet, a first spring, a cup body, a second spring and an adjusting base are arranged between the screw knuckle and the fixing base in the knuckles of the two hinge leaves, the fixing pin has a screw pin screwed into the screw knuckle, and the first spring is abutted between the fixing pin and a front end surface of the cup body, the first magnet is movable with the fixing pin, and an end of the second spring abuts against the fixing base, another end of the second spring abuts against the second magnet, the second magnet is movable relative to the fixing base, the first magnet and the second magnet are magnetically attracted, the adjusting base is adjusted to rotate so as to correspond and match the second magnet, the fixing base and a bottom of the cup body, to adjust and shrink a distance between the second magnet and the fixing base; the adjusting base is adjusted to rotate to fit the second magnet and the bottom of the cup body, to adjust and shrink a distance between the second magnet and the first magnet.

Compared with the background technology, this technical solution has the following advantages:

The screw knuckle and the fixing base are provided with a fixing pin and a screw ring, two magnets and two springs and an adjusting base. When the two hinges are rotated relatively with respect to each other, the screw knuckle and the screw pin in the connecting knuckle inside the two pin knuckles can rotate relatively with respect to each other, so that the teeth of six straight-pitch convex spiral pins among the two or more pins of the fixing pin can slide axially downward relative to the concave spiral teeth of the six among the two or more straight-pitch pitches of the screw knuckle. The teeth of the six straight-pitch convex spiral pin among the two or more pins of the screw pin slide axially downward relative to the concave spiral teeth of the six among the two or more straight-pitch pitches of the screw knuckle, so that axial downward and upward movements of the screw knuckle and the screw pin are within a predetermined angle. The two magnets held by the fixed pin are balanced by the magnetic force and the top force converted by the elastic force of the two springs, so that the leaves of the hinge can be self-positioned at the predetermined position angle. It is convenient to use, and at the same time, when the angle in the predetermined setting positioning is below the starting point of the positioning, the leaf of the hinge can realize the self-closing function, and the adjusting base is used to adjust the rotation to cooperate with the fixing base and the two magnets and the bottom of cups. It is possible to adjust and reduce the distance between the second magnet and the fixing base, so that the second magnet and the first magnet can be strongly attached together in the connecting knuckle with strong magnetic attraction. The predetermined setting positioning angle of the leaf of the hinge can be correspondingly adjusted, a predetermined positioning angle in a single positioning angle from the starting position of the following starting point of the following hinge leaf can be self-closing, both leaves rotate to a predetermined setting positioning angle of a positioning angle position starting self-positioning, and in a predetermined setting positioning angle in the positioning angle is the starting point of the self-positioning position where the leaf below the hinge can be self-closed, so that the adjustment base can fit the bottom of the second magnet, the holder and the cup body, so as to be able to adjust and close the distance between the second magnet and the first magnet so that the second magnet and the first magnet can be strongly attached together in the connecting knuckle with a strong magnetic attraction, so that the adjusting base can be adjusted correspondingly. The predetermined positions of the leaf need to be set to self-positioning in the positioning angle positions so that the hinges can be self-positioned at a certain positioning angle position among the desired predetermined setting positioning angles, and the hinge position can be set at a positioning angle in the predetermined setting positioning angles. When the starting position of the self-positioning is less than or equal to the starting point, the leaf of the hinge can realize the self-closing function.

DESCRIPTION OF THE DRAWINGS

The present invention will be further described below with reference to the accompanying drawings and embodiments.

DETAILED DESCRIPTION

Embodiment 1

Figure 1:
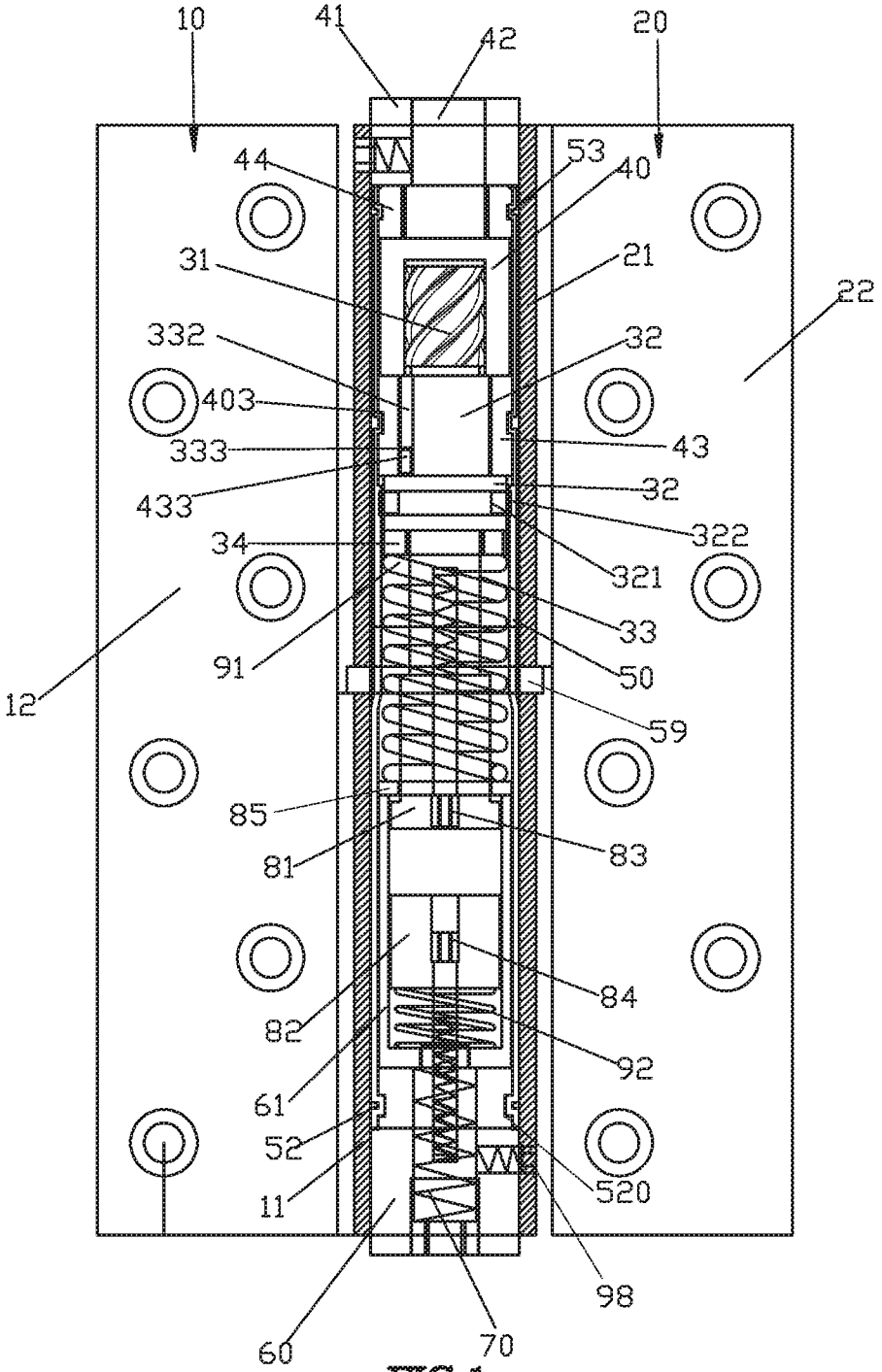
FIG. 1 is a schematic structural diagram of the hinge of the Embodiment 1.
Figure 2:
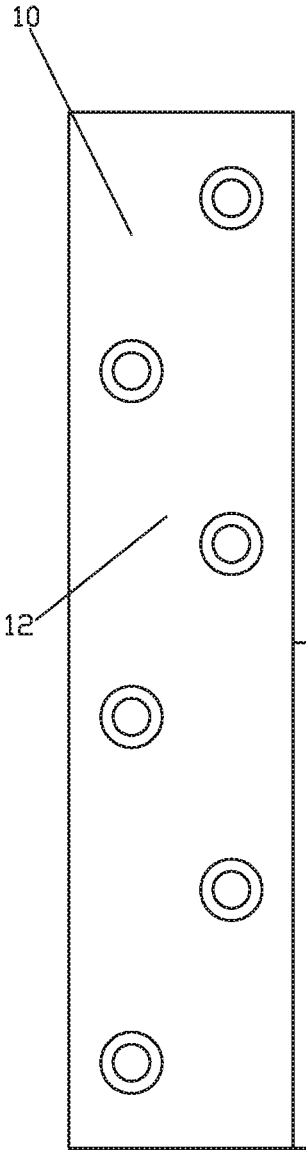
FIG. 2 is a schematic structural diagram of the left hinge of the Embodiment 1.
Figure 3:
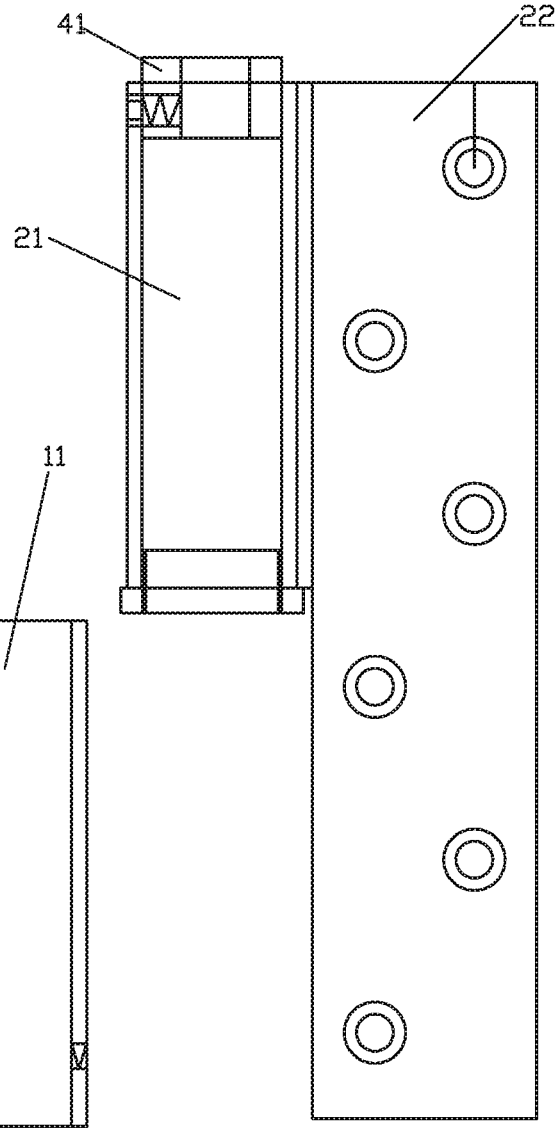
FIG. 3 is a schematic structural diagram of the right hinge of the Embodiment 1.
Figure 4:
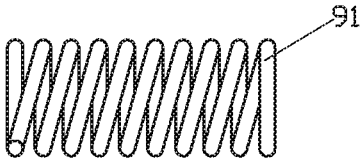
FIG. 4 is a schematic structural diagram of the first spring according to the Embodiment 1.
Figure 5:
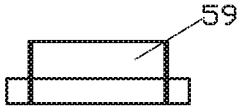
FIG. 5 is a schematic structural view of the third bearing of the Embodiment 1.
Figure 6:
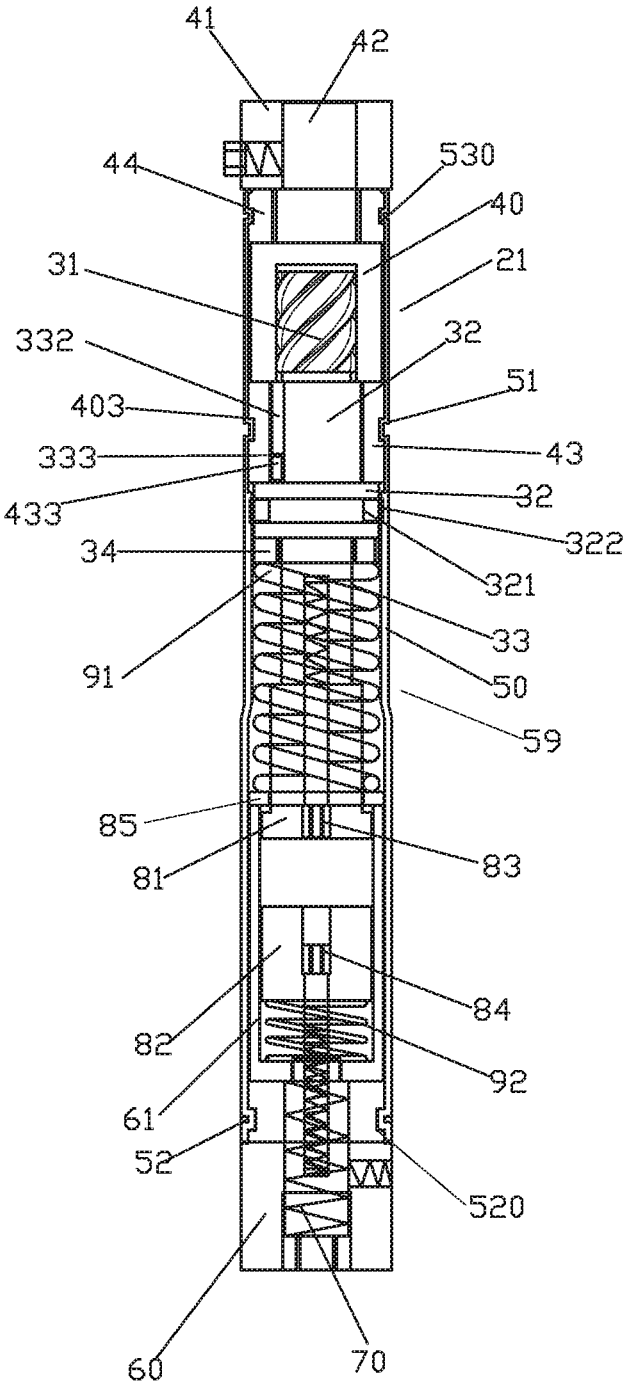
FIG. 6 is a schematic view of an assembly structure of the connecting knuckle according to the Embodiment 1.
Figure 7:
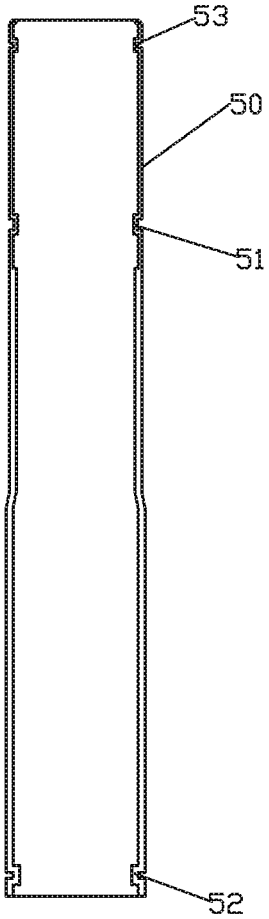
FIG. 7 is a schematic structural view of the connecting knuckle according to the Embodiment 1.
Figure 8:
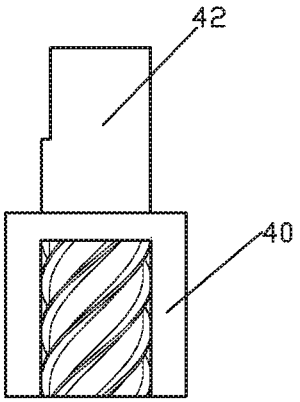
FIG. 8 is a schematic structural view of the screw knuckle of the Embodiment 1.
Figure 9:
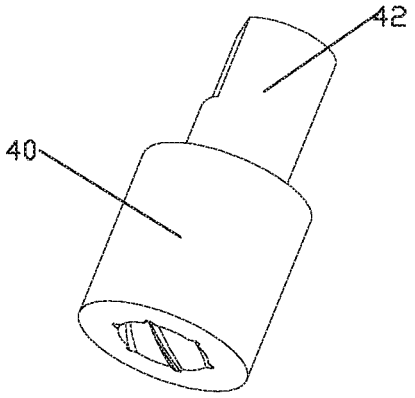
FIG. 9 shows a three dimensional view of the screw knuckle of the Embodiment 1.
Figure 10:
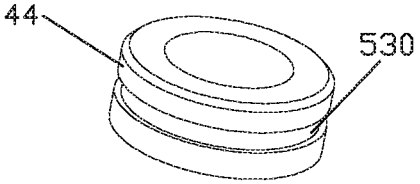
FIG. 10 is a three dimensional view of the first bearing of the Embodiment 1.
Figure 11:
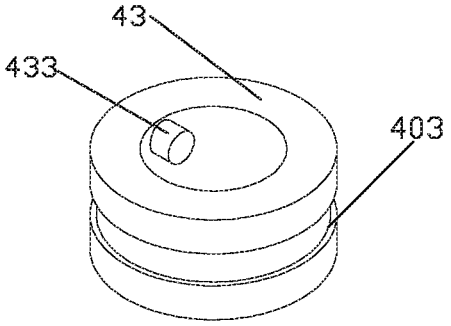
FIG. 11 illustrates a three dimensional view of the screw ring of the Embodiment 1.
Figure 12:
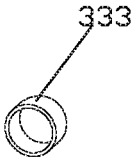
FIG. 12 shows a three dimensional view of the slip knuckle of the Embodiment 1.
Figure 13:
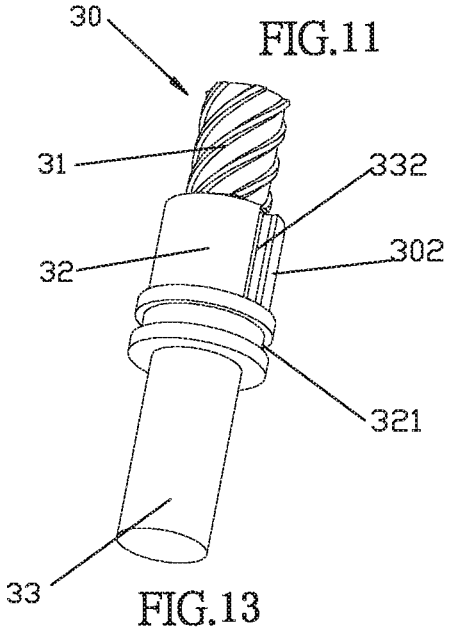
FIG. 13 is a three dimensional view of the fixing pin according to the Embodiment 1.
Figure 14:
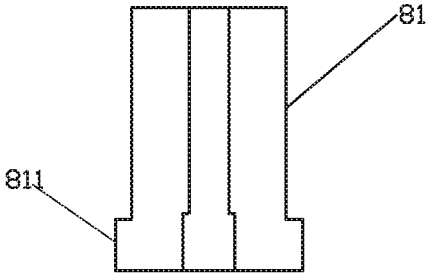
FIG. 14 is a schematic structural diagram of the first magnet according to the Embodiment 1.
Figure 15:
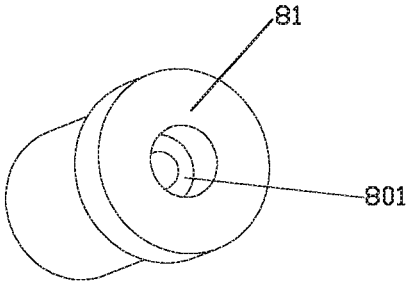
FIG. 15 is a three dimensional view of the first magnet of the Embodiment 1.
Figure 16:
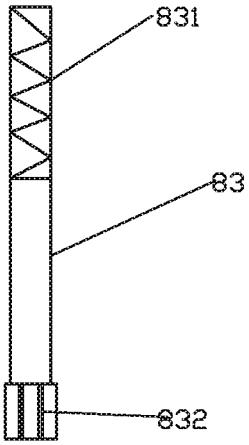
FIG. 16 is a schematic structural view of the first screw of the Embodiment 1.
Figure 19:
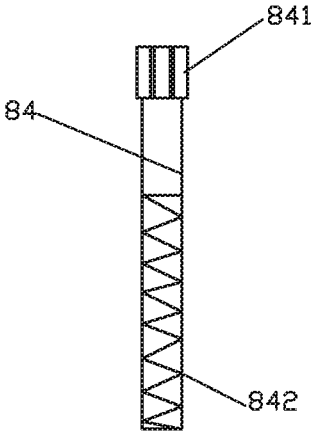
FIG. 19 is a schematic structural view of the second screw according to the Embodiment 1.
Figure 17:
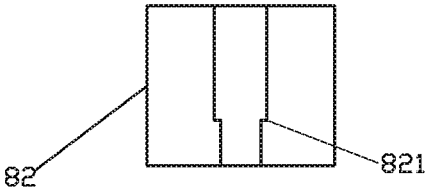
FIG. 17 is a schematic structural view of the second magnet of the Embodiment 1.
Figure 18:
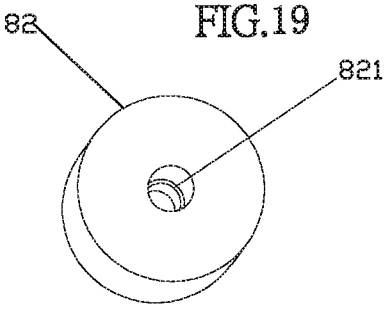
FIG. 18 is a three dimensional view of the second magnet of the Embodiment 1.
Figure 20:
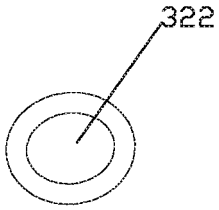
FIG. 20 shows a three dimensional view of the sealant ring of the Embodiment 1.
Figure 21:
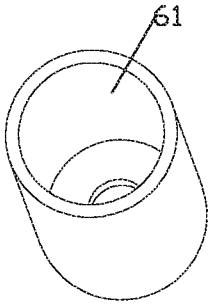
FIG. 21 is a three dimensional view of the cup body of the Embodiment 1.
Figure 22:
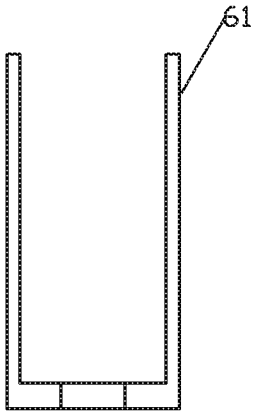
FIG. 22 is a schematic structural view of the cup body according to the Embodiment 1.
Figure 23:
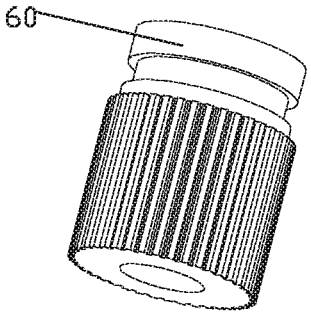
FIG. 23 is a three dimensional view of the fixing base of the Embodiment 1.
Figure 24:
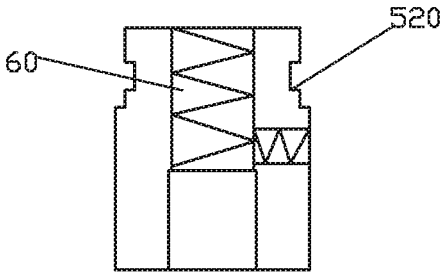
FIG. 24 is a schematic structural view of a fixing base according to the Embodiment 1.
Figure 25:
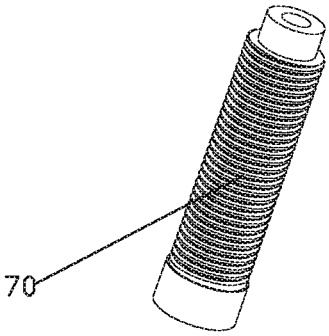
FIG. 25 is a three dimensional view of the adjusting base of the Embodiment 1.
Figure 26:
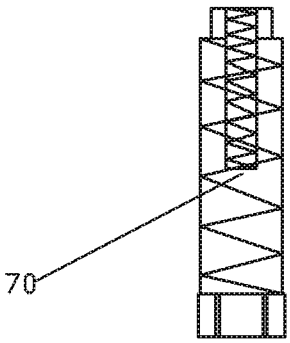
FIG. 26 is a schematic structural view of the adjusting base according to the Embodiment 1.

The structure and structural accessories of the hinge according to the present invention are suitable for being set in hinge knuckles of any shape, including butterfly hinges, H-type hinges, sub-matrix hinges, flag hinges, car door hinges, and car door folding hinges and any strange hinges, and so on. The adjustable-angle positioning and self-closing hinges can be fitted to any door leaf, any door and any window, any car door, etc. The predetermined setting positioning angle of the adjustable-angle positioning and self-closing hinge can be set to a predetermined setting positioning angle 20 degrees to 180 degrees. Within such range from 20 degrees to 180 degrees, at a start position corresponding to any one of the predetermined setting positioning angle, the hinge leaves can realize self positioning; and in the position start of any one of predetermined setting positioning angle, the hinge leaves can self position below the position start point, so that the leaves of the hinge can be self closing.

Referring to FIG. 1 to FIG. 7, the hinge comprises a left hinge 10 and a right hinge 20. The left hinge 10 comprises a left knuckle 11 and a left leaf 12 fixedly attached to the left knuckle 11. The left knuckle 11 is disposed at the lower half of the left leaf 12. The right hinge 20 comprises a right knuckle 21 and a right leaf 22 fixedly attached to the right knuckle 21. The right knuckle 21 is disposed on the upper half of the right leaf 22. By means of a fixing screw 98 that passes through the screw through hole of the right knuckle 21 and then locks in and through the swivel ring 41 and then locks in the fixing thin pin 42, the right knuckle 21, the swivel ring 41, and the thin pin 42 can be fixed together. A second flange 52 is provided in the connecting knuckle 50. The second flange 52 can abut against the annular groove 520 of the plug in the connecting knuckle 50 so that the second flange 52 can be embedded into the annular groove 520 of the fixing base 60 in the connecting knuckle 50, so that the fixing base 60 and the second flange 52 can be fixed in the connection knuckle 50. The portion of the fixing base 60 protruding from the outer of the connecting knuckle is screwed through the left knuckle 11 through the fixing screw 98 and then locked in the fixing base 60 so that the left knuckle 11 and the fixing base 60 are fixed together.

Reference is made to FIG. 1 to FIG. 26. The hinge further comprises a fixing pin 30, a screw knuckle 40, a connecting knuckle 50, a fixing base 60 and an adjusting base 70. The connecting knuckle 50 is connected in the left knuckle 11 and the right knuckle 21. The left knuckle 11 and the right knuckle 21 are arranged side by side and up and down so that the two hinges can rotate relative to each other; a third bearing 59 can also be rotated and sheathed outside the connecting knuckle 50; the third bearing 59 can be rotatably connected between the circumferential surface of one end of the left knuckle 11 and the circumferential surface of the right knuckle 21 so that the right hinge 20 can rotate more smoothly relatively to the axis of the left hinge 10. The left knuckle 11 and the right knuckle 21 are arranged side by side, so that the hinges can rotate relative to the axis.

The screw knuckle 40 is rotatably and non-slidably connected to the connecting knuckle 50 in the right knuckle 21, and the swivel ring 41 of the right hinge 20 in the right knuckle 21 and the portion of the thin pin 42 of the screw knuckle 40 extending outside the connecting knuckle 50 are fixedly connected. The fixedly connection is provided with a swivel ring 41; the upper portion of the screw knuckle 40 is provided with a thin pin 42 in a concave way. The thin pin 42 of the screw knuckle 40 can rotate through the swivel ring 41. The swivel ring 41 fits in the upper end portion of the right knuckle 21 and is screwed into the screw through hole of the right knuckle 21 through a fixing screw 98 and is locked in and penetrates the swivel ring 41 and then be locked in the fixing thin pin 42 again so that the right knuckle 21 and the swivel ring 41 and the thin pin 42 are fixedly connected together, so as to be able to locate the position the positional distance between the axial direction and the circumferential direction of the sliding and moving of the fixing pin relative to the axis along the axis relative to the knuckle. The swivel ring 41 and the right knuckle 21 also can limit and control the axial movement of the screw knuckle 40. A second flange 52 is provided in the connecting knuckle 50, and the second flange 52 can abut in the annular groove 520 of the fixing base 60 in the connecting knuckle 50, so that the second flange 52 can be embedded in the annular groove 520 of the fixing base 60 in the connecting knuckle 50, so that the fixing base 60 and the second flange 52 can be connected and fixed in the connection knuckle. The portion of the fixing base 60 protruding from the outer of the connecting knuckle 50 is screwed into screw through hole of the left knuckle 11 through the fixing screw 98, then locked into the fixing base 60, and then screwed in and fixed to the adjusting base 70. At the same time, the fixing screw 98 is firstly not used for locking and fixing the adjusting base 70, together with the assistance of the left knuckle 11 and the fixing base 60; instead, firstly the adjusting base 70 is adjusted and rotated to fit to the fixing base 60 and the second magnet 82 and the base of the cup body 61, so as to adjust the distance position between the second magnet 82 and the first magnet 81, such that the second magnet and the first magnet can be magnetically attached together to be positioned in the connecting knuckle, so that the adjusting base can correspondingly adjust the predetermined setting positioning angle of the hinge leaves, so that the hinge leaves can be in the predetermined setting positioning angle; after the required angle between the predetermined setting positioning angle is self-positioning, then the fixing adjusting base 70 is screwed using a waiting fixing screw 98 to prevent the adjusting base 70 from loosening. The screw knuckle and the fixing base are spaced separately, and a fixing pin 30, a screw ring 43, a first magnet 81, a second magnet 82, a cup body 61, a spacer 85 and a first spring 91 and a second spring 92 are arranged between the screw knuckle and the fixing base in the connection knuckle. The fixing pin 30 has a screw pin 31, and the first magnet 81 and the second magnet 82 magnetically attract each other. The energy stored in the magnets owing to the magnetic attraction force and that is going to be released is greater than the energy stored in the the first spring 91 due to spring force plus the energy stored in the first spring due to its reload force. Here, the first magnet of the hinge is a steel that has no energy storage magnetic force or the second magnet is a steel that has no energy storage magnetic force. A magnet between the two magnets is a steel that has no stored magnetic force, and a magnet that has a stored magnetic force can also make the hinge leaves be self-positioned at a single positioning angle among a range of predetermined setting positioning angles, and when such single positioning angle is below the angle of the starting point that corresponds to the self-positioning angular position, the hinged leaves can achieve self-closing. The fixing pin 30 has the teeth of the screw pin 31, the teeth of the screw pin 31 and the teeth of the screw knuckle 40 are opposite to each other so that the screw pin 31 of the pin 30 can slide and move relative to the screw knuckle 40 along the axis.

The fixing pin 30 comprises a screw pin 31. The screw pin 31 is screwed into the screw knuckle 40. The first spring 91 abuts between the fixing pin 30 and the gasket 85. The first magnet 81 and the connecting pin 33 are fixedly connected to slide together with the fixing pin 30 along the axis. One end of the second spring 92 can abut against the fixing base, and the other end of the second spring 92 can relatively press against the second magnet 82, and the second magnet 82 can move relative to the fixing base 60. The adjusting base 70 is matched with the second magnet 82 and the base of the cup body and the fixing base 60 so as to be able to adjust the distance between the second magnet 82 and the fixing base 60 The adjusting base 70 is adjusted to rotate to be matched with the fixing base 60 and the second magnet 82 and the base of the cup body 61 so as to adjust the distance between the second magnet 82 and the first magnet 81, so that the second magnet and the first magnet can be attached together to be positioned in the connecting knuckle and opposite to each other so that the adjusting base can correspondingly adjust the required positioning angle of the hinge leaf, so that the hinge can be self-positioned at a predetermined 90 degree positioning angle among a range of predetermined angles. Further, when under the position starting point of 90 degree positioning angle and within the range of the predetermined angles, the hinge of the hinge can be self-closing; when the hinge leaf of the hinge rotates to the starting position of the 90 degree positioning angle and within the range of the predetermined angles, the hinge leaf of the hinge can be self-positioning. Further, when under the position starting point of 90 degree positioning angle and within the range of the predetermined angles, the hinge leaf of the hinge can be self-closing, so that the adjusting base can correspond to the bottom of the second magnet and the fixing base and the base of the cup body, so that the distance between the second magnet and the first magnet can be adjusted, and the second magnet and the first magnet are opposite to each other so that the adjusting base can correspondingly adjust the required positioning angle of the hinge leaf so that it can be self-positioned at a predetermined angular position of a desired predetermined angle, and when below a positioning angular position point at a desired predetermined angle, the hinge leaf of the hinge can achieve self-closing function.

Preferably, a first flange 51 is disposed in the connecting knuckle 50, and the first flange 51 can abut in the annular groove 403 of the screw ring 43 in the connecting knuckle 50 so that the first flange 51 can embed the annular groove 403 in the connecting knuckle, so that the screw ring 43 and the first flange 51 and the connecting knuckle 50 are connected and fixed together in the connecting knuckle 50, so that the screw ring 43 cannot be rotated and cannot slide and can move and is fixedly connected in the connecting knuckle 50. The screw ring 43 is concavely provided with a through hole, and the inner ring of the through hole of the screw ring 43 is convexly provided with a screw ring inner ring flange 433. The fixing pin 30 has a protruding ring 32, and the outer ring of the protruding ring is concavely provided with a protruding ring sliding track groove 332 circumferentially, so that the inner ring flange 433 of the screw ring 43 can abut against the protruding ring sliding track groove 332, the inner ring flange 433 of the screw ring can be matched with the protruding ring sliding groove 332 of the protruding ring 32 provided by the fixing pin 30 so as to be able to position and limit the fixing pin. The distance between the axis and the wheelbase of the screw knuckle sliding and moving axially downward and upward does not change, can match the right leaf 21 of the right hinge to set positioning angle. The positioning angle of the right leaf 22 of the right hinge 20 can be set from the 50-degree positioning angle position to the 180-degree positioning angle position. For example, the right leaf 22 of the right hinge 20 needs to be self-positioning at a predetermined angle of 90 degrees between the predetermined angles. At the same time, when the leaf of the hinge is opened to a 90-degree positioning angle in a predetermined angle of 90 degrees, relatively the right leaf 22 of the right hinge 20 will drive screw knuckle in the connecting knuckle 50 in the knuckle to rotate. Six straight-pitch convex spiral pin teeth among two or more pins that the fixing pin has slides axially downward relative to the concave spiral tooth of the six in two or more straight pitch pitches of the screw knuckle. Six straight-pitch convex spiral pin teeth among two or more pins that the screw pin has slides axially downward relative to the concave spiral tooth of the six in two or more straight pitch pitches of the screw knuckle. At the same time, the fixing pin has a screw pin and a first magnet which correspondingly cooperates with the right leaf 22 of the right hinge 20 to slide downward and move to the hinged leaf till being opened to a desired 90 degree predetermined angle position, it is the positioning angle position of the desired 90 degree predetermined angle of the right leaf 22 of the right hinge 20, meanwhile, the right leaf 22 of the right hinge 20 has no positioning function. At the same time, when the right leaf 22 of the right hinge 20 needs to be positioned at a predetermined 90 degree positioning angle, it must through the adjustment and rotation of the adjusting base in the fixing base. The adjusting base in the fixing base is adjusted to rotate the adjusting base so that the adjusting base can correspond to the fixing base and the second magnet and the bottom of the cup body, in order to adjust the distance of the second magnet and the first magnet. The second magnet and the first magnet can be magnetically positioned together so that the second magnet and the first magnet can be positioned within the connecting knuckle, so that the adjusting base can adjust the 90-degree predetermined angular position between the predetermined angles required for the hinge leaves correspondingly. In order to allow the leaf of the hinge to self-position from the positioning angle position of 90-degree of the desired predetermined angle, however, the right leaf 22 of the right hinge 20 can also be opened to the angle of the 180 degree angle position of the predetermined rotation predetermined angle maximum limit point of the leaf of the hinge. After the 180 degree angular position is released, At the same time, the first spring is an energy-storage-elastic state of the first spring 91 that compresses the ring-shaped convex ring 32 of the fixing pin 30 with a strong force from top to bottom, so that the energy state a spring 91 is changed, so that the energy storage elastic force of one end of the first spring 91 can strongly support the annular protruding ring 32, and the energy storage elastic force of the other end of the first spring 91 stores energy can strongly support the gasket 85 and the frontal plane of the cup body 61, so that after the hinged leaves will self-close back to the predetermined angle that has been adjusted in place through the adjusting base in the fixing base and the 90-degree positioning angle position is self-positioned, the right leaf 22 of the right hinge 20 needs to be closed, so that the leaf positioning angle of the hinge disengages the 90-degree positioning between the predetermined angles that have been adjusted through the adjusting base in the fixing base. When the angle position is less than or equal to the starting point, the right leaf 22 of the right hinge 20 can realize the self-closing function. The screw ring 43 is located under the screw knuckle and the screw pin 31 is threaded through the screw ring 43 and then screwed into the screw knuckle 40 so that the screw ring 43 can limit the rotation and sliding of the screw pin 31 with respect to the screw knuckle 40, and the resulting size factor are able to position and limit the fixing pin so that the distance between the axis and the wheelbase of the fixing pin in the axial downward and upward sliding and moving relative to screw knuckle does not change, it can cooperate to the leaf of the hinge and the positioning angle can be freely set and predetermined, and it can also relatively match the leaf of the hinge to self-position at positioning angle between the predetermined angle, a required positioning angle of the predetermined angle. Wherein, the fixing pin 30 has a protruding ring 32 with a protruding ring sliding track groove 332 at the outer ring circumferential surface. The peripheral circumferential front edge of the through hole of the spiral ring is convexly provided with an inner ring flange 433. The flange 433 is provided so that the inner ring flange of the screw ring can abut against the protruding ring sliding track groove, so that the inner ring flange 433 of the screw ring can correspond to the matching protruding ring sliding track groove 332, in order to position and limit the fixing pin so that the distance between the axis and the wheelbase of the fixing pin in the axial downward and upward sliding and moving relative to screw knuckle does not change, it can match the right leaf of the right hinge to set the positioning angle. Wherein, a third flange 53 is disposed in the connecting knuckle 50, and the third flange 53 can abut in the annular groove 530 of the first bearing in the connecting knuckle 50 so that the third flange 53 embed the annular groove 530 of the first bearing in the connecting knuckle 50, so that the first bearing 44 and the third flange 53 cannot be connected with the connecting knuckle in an upper and lower movably connected manner (by providing a third flange 53 in the connecting knuckle, so that the third flange 53 can be fitted into the annular groove 530 of the first bearing in the connecting knuckle 50, so as to axially restrain the first bearing 44 from being displaced); the second bearding 34 is provided between the annular protruding ring 32 of the fixing pin 30 and the first spring 91. A second bearing 34 is also sleeved on the connecting pin 33 of the fixing pin 30, the spring 91 is sleeved on the connecting pin 33. The second bearing 34 is bushed on the connecting pin 33 of the fixing pin 30, and one end of the first spring 91 can abut the second bearing 34, the other end of the first spring 91 can abut between the gasket 85 and the circumferential plane surface of the cup bottom end of the cup body 61. A second flange 52 is provided in the connecting knuckle 50. The second flange 52 can abut the annular groove 520 of the plug in the connecting knuckle 50 so that the second flange 52 can embed the annular groove 520 in the connecting knuckle 50, so that the fixing base 60 and the second flange 52 cannot be relatively slidably and movably connected and fixed in the connecting knuckle, and the fixing base 60 protrudes outward from the connecting knuckle to be fixed to the left knuckle 11. The connecting knuckle 50 can be a center knuckle 50.

Wherein: further comprises a first screw 83 and a second screw 84, and a fixing screw 98, both of the first screw 83 and the second screw 84 have a smooth pin section and threaded sections 831, 841 at the end; the smooth pin section of the first screw 83 passes through the inner ring through hole of the first magnet 81, and the thread section 831 is screwed into the connecting pin 33 of the fixing pin 30 so that the screw head 832 of the first screw 83 is supported on the step 801 of the inner ring through hole of the first magnet 81, so that the first magnet 81 and the connecting pin 33 are fixed together so that the first magnet 81 can slide and move together with the fixing pin 30 up and down, and the first magnet can be restricted from being detached from the first screw. The adjusting base 70 can be correspondingly matched so that the adjusting base 70 can correspond to match the fixing base 60 and the second magnet 82, so that the adjusting base 70 is adjusted to rotate so as to be able to correspond to the fixing base 60, the second magnet 82 and the bottom of the cup body 61, to adjust and shrink the distance between the second magnet 82 and the first magnet 81 so that the second magnet and the first magnet can be magnetically sucked together to be positioned in the connecting knuckle so that the adjusting base is relatively can match the positioning angle of the leaf of the hinge so that the hinge leaves can be at a predetermined angle, and self-positioning at the required position angle position is self-positioning; the light pin section of the second screw 84 passes through the inner ring through hole of the second magnet 82, and the threaded section 841 is screwed into the end surface of the adjusting base 70 so that the screw head 842 of the second screw 84 is supported at the inner ring through hole step 821 of the second magnet 82 so that the second magnet 82 and the second screw 84 are connected with the adjusting base 70, and the second magnet 82 can be restricted from disengaging with the second screw 84 so that the second magnet 82 can co-operate with the fixing base 60 and the adjusting base 70, so that the adjusting base 70 can be adjusted to rotate so that the distance between the second magnet 82 and the first magnet 81 can be adjusted and shrink, relatively so that the adjusting base can adjust the positioning angle of the leaf of the hinge correspondingly to the adjustment hinge.

Wherein the fixing pin 30 has a fixed protruding ring 32 at the end of the screw pin 31, an annular protruding part is fixed to the protruding ring 32, and a connecting pin 33 is fixed to the annular protruding part, and the protruding ring 32 and the annular protruding part is fixedly connected together. An annular groove 321 is recessed in a circumferential direction of the outer ring of the annular protruding ring 32, and the annular groove 321 of the annular protruding ring is bushed with a sealing rubber ring 322, and the sealing rubber ring 322 also protrudes out of the annular mounting groove 321, so as to be able to seal and abut in the connecting knuckle 50, and the sealing rubber ring 322 can cooperate with the annular protruding ring 32 to slide and move up and down in the connecting knuckle 50, so as to create a sealing damping force and resistance force within the connecting knuckle 50 and to enhance the damping and resistance forces generated by the sliding and moving of the annular protruding ring 32 below and above the connecting knuckle 50. The effect is relatively stronger, so that the intensity of the self-positioning force of the annular protruding ring in the connecting knuckle 50 is more enhanced, and the energy-storing magnetic attraction force of the second magnet and the first magnet is strengthen correspondingly. So that the second magnet and the first magnet can be positioned together with strong magnetic attraction within the knuckle 50, the strength of the self-positioning force of the right leaf 22 of the right hinge 20 at a positioning angle position between the predetermined setting positioning angle positions is more enhanced, and the release of the top force of the first spring's energy storage is relatively controlled and limited simultaneously, so that the abutment force and pull-up speed of the first spring's energy storage top force in the upward force on the annular protruding ring of the fixing pin can be slowed down and buffered, but also relatively to the speed of the self-closing of the leaves of the hinges can be controlled and limited, and also can enhance and strengthen the safety performance of the adjustable-angle positioning and self-closing hinges.

Wherein, a cup body 61 capable of relative movement in the connecting knuckle 50 is also included. The second spring 92 abuts between the cup bottom of the cup body 61 and the second magnet 82, and the adjusting base 70 connects the bottom of the cup body 61 and the fixing base for adjusting the distance between the bottom of the cup and the fixing base, and the position of the spacing between the bottom of the cup and the fixing base is adjusted and shrink and then the distance between the fixing base and the second magnet can be adjusted. The adjusting base is adjusted and rotated to correspondingly fit the second magnet and the fixing base and the bottom of the cup body, so that the distance of the second magnet and the first magnet can be adjusted and shrink, so that the second magnet and the first magnet can be magnetically attracted together and can be positioned in the connecting knuckle, so that the adjusting base can adjust the positioning angle of the hinge leaves correspondingly, so that the hinge can be self-positioned at the predetermined 90 degree positioning angle position, and at a predetermined angle, and below the starting point of the 90-degree positioning angle, the hinge point where the hinge leaves can self-close, the 90-degree positioning angle position where the hinge rotates to the predetermined angle, and the starting point of the 90-degree positioning angle position in the predetermined setting positioning angle, the leaves of the hinge achieve self-closing function. For example, if the right leaf 22 of the right hinge 20 needs to be self-positioned at a predetermined angular position in a predetermined set position angle, when the leaf of the hinge is opened to a predetermined angular position in a predetermined set position angle, relatively so that the right leaf 22 of the right hinge 20 will drive the screw knuckle in the connecting knuckle 50 inside the knuckle to rotate, six straight-pitch convex spiral pin teeth among two or more pins that the screw pin has slides axially downward relative to the concave spiral tooth of the six in two or more straight pitch pitches of the screw knuckle. so that the screw pin provided by the fixing pin can slide and move along the axis relative to the screw knuckle. At the same time, has the screw pin and a first magnet provided the fixing pin correspondingly cooperates with the right leaf 22 of the right hinge 20 to slide downwards and move to the hinged leaf to be opened to a desired predetermined angular position, opposite to the right hinge. A right angle in the predetermined angle of the right leaf 22 of the 20 is required. At the same time, the leaf of the hinge has no positioning function. At the same time, the right leaf 22 of the right hinge 20 needs to be positioned at a predetermined angle. When positioning, be sure to pass The adjusting base in the fixing base is adjusted to rotate the adjusting base so that the adjusting base can correspond to the bottom of the base of the fixing base and the second magnet and the cup body so as to be able to adjust and adjust the distance between the second magnet and the first magnet. So that the second magnet and the first magnet can be magnetically sucked together so as to be positionable in the connecting knuckle, so that the adjusting base can adjust the predetermined angular position required by the hinge to adjust the hinge so that the right leaf 22 of the right hinge 20 A desired position angle position in a desired predetermined angle can be self-positioned, but the right leaf 22 of the right hinge 20 can also be opened to a 180 degree angle of a predetermined limit angle of a predetermined rotation angle of the leaf of the hinge. At this time, the right leaf 22 of the right hinge 20 is self-closed and returns to a predetermined angle between the predetermined angles that have been adjusted through the adjusting base in the fixing base. After positioning, the hinge leaf needs to be closed, so that the right The positioning angle of the right leaf 22 of the hinge 20 is deviated from a positioning angle position of the predetermined setting positioning angle that has been already adjusted through the adjusting base in the fixing base to be below the starting position of the positioning position so that the right hinge of the right hinge 20 is reached. 22 can achieve self-closing function.

In a specific structure, the adjusting base 70 is a third screw, and the third screw is screwed through the protruding portion of the fixing base and abuts against the cup bottom of the cup body, and the third screw is adjusted to rotate with the fixing base and the first portion. The two magnets can adjust and adjust the distance between the second magnet and the first magnet. Preferably, the threaded section 841 of the second screw 84 is screwed into the end surface of the adjusting base 70 of the fixing base 60. The second spring and the second magnet are completely located in the cup body. The second magnet fits in sliding contact with the cup body, and the lower portion of the first magnet fits in sliding contact with the cup body.

Wherein: the screw is restricted and controlled by the screw knuckle and the screw ring, and the teeth of the screw is adapted to the teeth of the screw knuckle, and the inner ring flange 433 of the screw ring is also engaged with the protruding ring sliding track grooves 332 of the protruding ring provided by the fixing pin 30, so as to generate a predetermined and fixed angle interval lower and upper sliding and moving relative to each other, so that it can position distance size factor position relative to the axial direction of the screw pin sliding and moving relative to the screw knuckle along the axis. And the distance between the wheelbase and the size factor position, so that the screw can slide and move relative to the screw knuckle in a predetermined setting of the spacing size position, relative to the hinged leaf so that the leaf of the hinge can be freely set to set the positioning angle. When the leaf of the hinge is opened to a positioning angle of 90 degrees, it can drive the screw knuckle in the connecting knuckle in the knuckle to rotate, so that the screw in the fixing pin in the connecting knuckle can slide and move along the axis relative to the screw knuckle. At the same time, the pin and the first magnet of the fixing pin will slide and move downwards. At the same time, when the hinge is opened to a positioning angle of 90 degrees, at the same time, the leaf of the hinge has no positioning function. The leaf of the hinge When positioning at a 90 degree positioning angle, the adjusting base must be adjusted through the adjusting base in the fixing base so that the adjusting base can correspond to the base of the fixing base and the second magnet and the cup body so as to be adjusted and adjusted The distance between the second magnet and the first magnet is sized so that the second magnet and the first magnet can be magnetically sucked together to be positioned in the connecting knuckle so that the adjusting base can adjust the predetermined setting required for the hinge of the hinge. Positioning angle, so that the leaves of the hinge can be self-positioned at a desired 90-degree positioning angle of a predetermined set positioning angle, relative to a hinge angle of 85 degrees between a predetermined angle of 85 degrees and a predetermined angle of 180 degrees. After the positioning angle position is self-positioned, when the leaf of the hinge needs to be closed, so that the positioning angle of the leaf of the hinge disengages from the 90-degree positioning angle, when the positioning angle of the leaf of the hinge is lower than the 90-degree positioning angle in the predetermined setting positioning angle At the same time, at the same time, the energy storage elastic force of the first spring is a state in which the annular protruding ring provided by the fixing pin compresses the stored energy elastic force so that the state of the energy storage elastic force of the first spring changes. The elastic force is released so that the screw pin and the bearing provided by the fixing pin can be lifted upward, and the screw thread tooth of the screw thread can be adapted to the thread teeth of the thread insert, so that the axial and circumferential angles of the predetermined arrangement are slid and moved upwards. So that the leaves of the hinge can be closed. A first flange 51 is provided in the connecting knuckle 50, and the first flange 51 in the connecting knuckle 50 can abut in the annular groove 403 of the screw ring 43 in the connecting knuckle 50 so that the first flange 51 is An annular groove 403 can be set in the connecting knuckle 50 so that the screw ring 43 and the first flange 51 and the connecting knuckle 50 are connected and fixed together in the connecting knuckle 50, so that the screw ring 43 cannot rotate The sliding and moving connection is fixedly connected in the connecting knuckle 50, and the inner circumferential edge of the inner ring of the screw ring penetrating the through hole is convexly provided with an inner ring flange of the screw ring, and the fixing pin has an outer ring side of the protruding ring. There is a protruding ring sliding track groove so that the inner ring flange of the screw ring can abut against the protruding ring sliding track groove, so that the inner ring flange of the screw ring can correspond to the sliding of the matching protruding ring. The track groove can be used to position and limit the distance between the axial and the wheelbase of the sliding and moving of the fixing pin axially downward and upward relative to the screw knuckle. The positioning angle can also relatively correspond to a positioning angle between the predetermined angles of the leaves of the matching hinge, and a required positioning angle. Degree position self-positioning. Wherein: the inner ring flange 433 of the screw ring is bushed with a sliding knuckle 333 so that the screw ring inner ring flange 433 bushed on the sliding knuckle 333 can abut on the protruding ring sliding track In the groove 332, the screw ring inner ring flange 433 opposite to the knuckle sliding knuckle 333 can correspondingly match the protruding ring slide rail groove 332 of the protruding ring 32 provided by the fixing pin 30. The movement of the auxiliary reinforcing pin to slide and move along the axis relative to the upper knuckle relative to the insert knuckle is smoother, relative to the hinge leaf being smoother when it is opened and closed. The slide protruding ring 32 is a protruding ring 32. The first spring 91 and the second spring 92 can cause the right leaf 22 of the right hinge 20 to release after being opened to the 125 degree angular position where the right leaf 22 of the right hinge 20 is opened, and at the same time the right hinge 20 is The right leaf 22 is opened by a predetermined angle of 90 degrees between the predetermined positioning angle of 50 degrees to 180 degrees between the positioning angle, and the first spring 91 is the fixing pin 30 has The ring-shaped protruding ring 32 is compressed from the top to the bottom of the high-pressure elastic spring state of the first spring 91 to change the energy storage state of the first spring 91 so that the energy-storing elastic force is released, so that The energy storage spring at one end of the first spring 91 can strongly support the top ring protruding ring 32, and the energy storage spring at the other end of the first spring 91 has a strong strength top gasket 85 and a cup body. The front-end circumferential plane of the 61, at the same time, the second spring 92 is a high-pressure compression second spring in which the ring-shaped protruding ring 32 of the fixing pin 30 cooperates with the first magnet 81 and the second magnet 82 to have a high degree of strength from top to bottom. The energy storage state of 92 is changed so that the energy storage state of the second spring 92 is changed. In order to release the stored energy elastic force, the energy storage spring at one end of the second spring 92 can strongly support the second magnet 82, and the energy storage elastic force at the other end of the second spring 92 can be strong. The cup bottom of the force-supporting top cup body 61 is relatively opposite so that the first spring 91 and the second spring 92 can close the right vane 22 of the right hinge 20 so that the first spring 91 and the second spring 92 can make The right leaf 22 of the right hinge 20 is reset to a predetermined angular position of 90 degrees in the predetermined set position angle.

Embodiment 2

Figure 27:
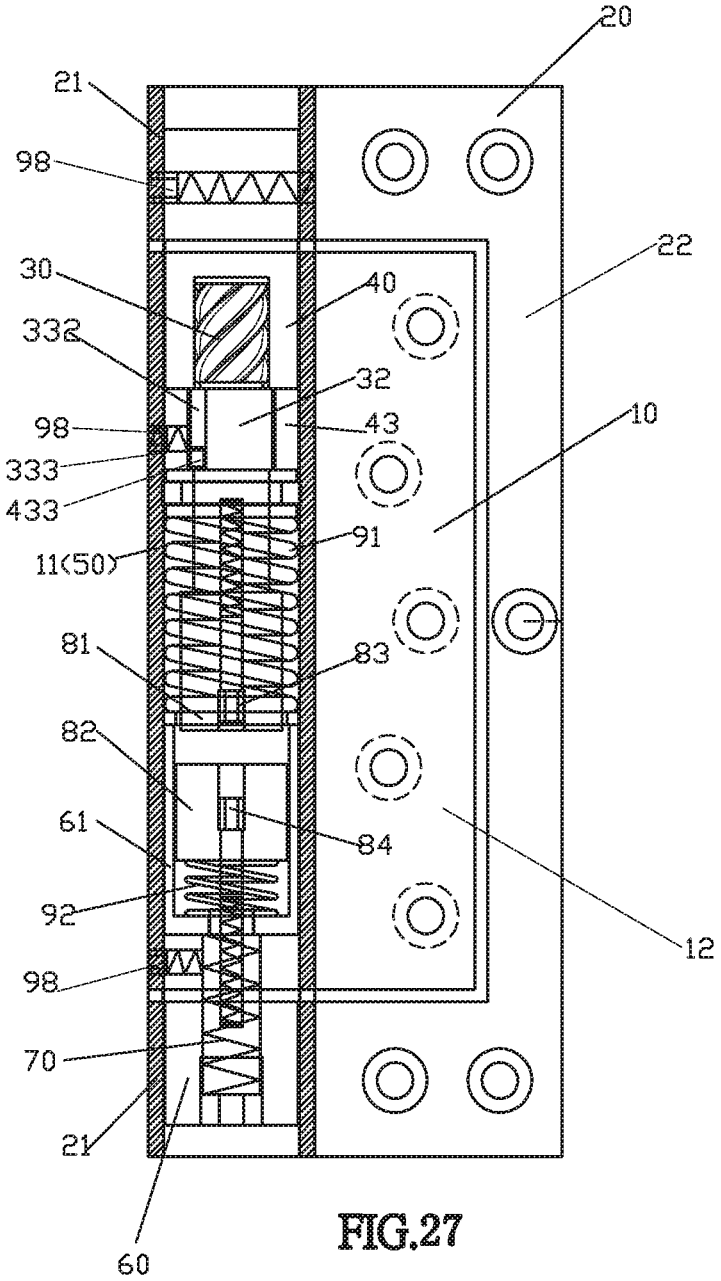
FIG. 27 is a schematic structural view of the hinge according to the Embodiment 2.
Figure 28:
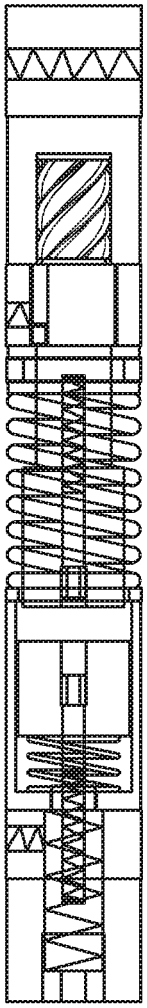
FIG. 28 is a schematic view of a mounting structure of the knuckle according to the Embodiment 2.
Figure 29:
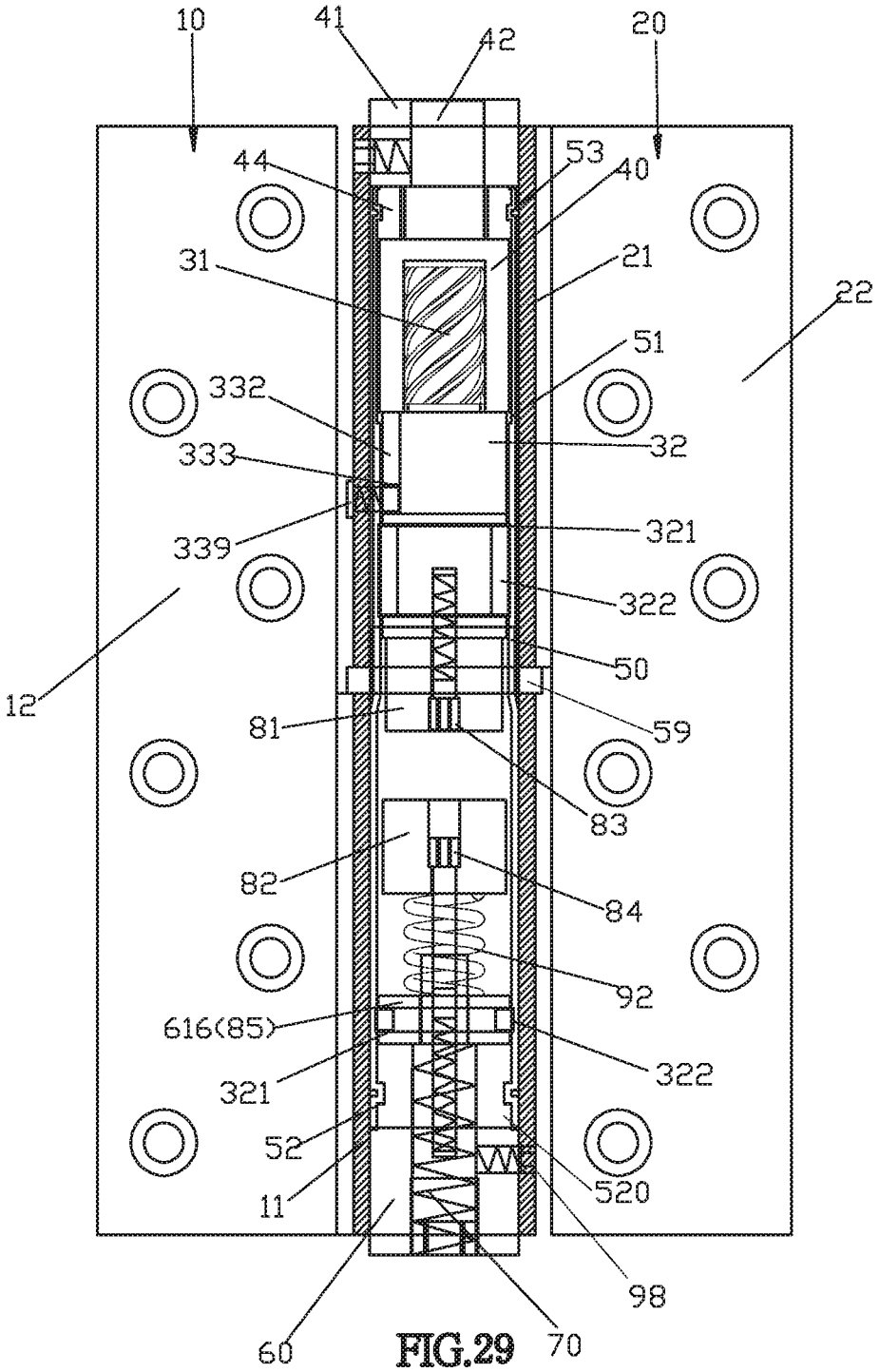
FIG. 29 is a schematic structural view of the hinge of the Embodiment 3.
Figure 30:
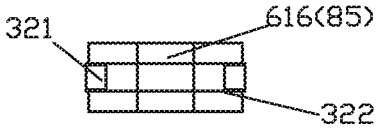
FIG. 30 is a schematic structural view of the gasket according to the Embodiment 3.
Figure 31:
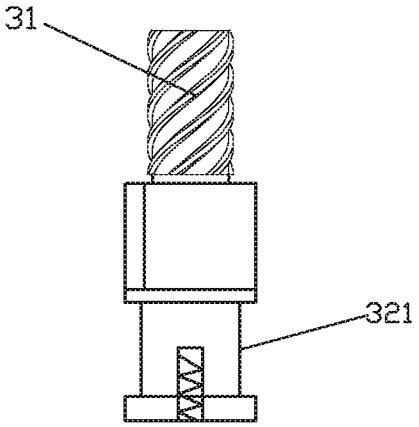
FIG. 31 is a schematic structural view of the fixing pin according to the Embodiment 3.
Figure 32:
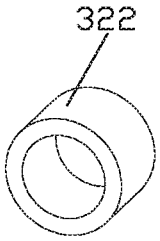
FIG. 32 shows a three dimensional view of the sealing rubber ring of the Embodiment 3.
Figure 33:
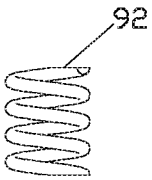
FIG. 33 is a schematic structural diagram of the second spring according to the Embodiment 3.

It differs from the Embodiment 1 in that: please refer to FIG. 27 and FIG. 28. The right hinge 20 is provided with two spaced separately above-mentioned right knuckles 21, the knuckle is a right knuckle 21, and the right leaf 22 is provided with a notch; the left hinge 10 is provided with one of the above-mentioned left knuckles 11, the knuckle is a left knuckle 11, and the left knuckle 11 is interposed between the two right knuckles 21, and the leaves fit into the notches. The connection knuckle is omitted and the left knuckle 11 constitutes the connection knuckle 50. The screw knuckle is screwed into the screw knuckle 40 through the screw through hole of the right knuckle 21 through the fixing screw 98, so that the screw knuckle 40 is fixed in the right knuckle 21 through the fixing screw 98. The portion of the screw knuckle 40 which protrudes out of the right knuckle 21 is rotatably connected in one end of the right knuckle 21, and the right hinge 20 and the right knuckle 21 can also restrict and control the axial movement of the screw knuckle 40, relative to position the distance factor position of the screw pin of the axial and circumferential sliding and moving along the axis relative to the screw, the fixing screw 98 passes through the screw through hole of the left knuckle 11 to screw into the screw ring 43 to lock the screw ring 43, so that the fixing screw 98 is fixed in the left knuckle 11 through the fixing screw 98, and a screw ring inner ring flange is convexly arranged on a circumferential forward edge of the inner ring through hole of the screw ring, and the outer ring side surface of the fixing pin is provided with the protruding ring sliding track groove, so that the inner ring flange of the screw ring can abut against the protruding ring sliding track groove, so that the inner ring flange of the screw ring can correspond to abut and fit the protruding ring sliding track groove, in order to locate and limit the axial and wheelbase spacing of the fixing pin in the axial direction and the distance between the axial direction and the upward direction of the relative knuckle is not changed, it can be matched with the leaf of the hinge to set the positioning angle. The fixing base 60 is fixed in the two knuckles. The slide protruding ring 32 is a protruding ring 32. The connecting knuckle 50 is a center knuckle 50.

Embodiment 3

It differs from the Embodiment 1 in that: referring to FIG. 29 to FIG. 33, the hinge comprises a left hinge 10 and a right hinge 20; the left hinge 10 comprises a left knuckle 11 and a left leaf 12 fixed on the left knuckle 11, the left knuckle 11 is disposed at the lower half of the left leaf 12. The right hinge 20 comprises a right knuckle 21 and a right leaf 22 fixedly attached to the right knuckle 21. The right knuckle 21 is disposed on the upper half of the right leaf 22 and is screwed into the screw through hole of the right knuckle 21 through the fixing screw 98 to be locked into the swivel ring and then locked into fixing swivel ring, so as to make the right knuckle 21 and the swivel ring 41 are fixed together with the thin pin 42; a second flange 52 is provided on the connecting knuckle 50, and the connecting knuckle 50 fits the second flange 52 so that the fixing base 60 can be fixed in the connecting knuckle 50. The portion of the fixing base 60 which protrudes out of the connection knuckle is screwed into the screw through hole of the left knuckle 11 through a fixing screw 98, and is fastened to the fixing base 60 so that the left knuckle 11 and the fixing base 60 are fixed together. The hinge also comprises a fixing pin 30, a screw knuckle 40, a connecting knuckle 50, a fixing base 60 and an adjusting base 70. The connecting knuckle 50 is connected in the left knuckle 11 and the right knuckle 21. The left knuckle 11 and the right knuckle 21 are arranged side by side and up and down so that the two hinges can rotate relative to each other; the third bearing can also be rotated and attracted outside the connecting knuckle 50, the third bearing 59 is bushed and connected between the circumferential surface of one end of the left knuckle 11 and the circumferential surface of the right knuckle 21 so that the right hinge 20 rotates relative to the axis of the left hinge 10 more smoothly, the left knuckle 11 and the right knuckle 21 are arranged side by side, so that the hinges can rotate relative to the axis.

The screw knuckle 40 is rotatably and non slidably connected in the connecting knuckle 50 in the right knuckle 21, and the swivel ring 41 of the right hinge 20 in the right knuckle 21 and the portion of the thin pin 42 of the screw knuckle 40 which extends out of the connecting knuckle 50 is fixedly connected, and a swivel ring 41 is arranged on the fixedly connection. The upper portion of the screw knuckle is convexly provided with a thin pin 42, the thin pin 42 of the screw knuckle 40 can rotate through the swivel ring 41. The swivel ring 41 fits in the upper portion of the right knuckle 21, and is screwed into the screw through hole of the right knuckle 21 through a fixing screw 98 and is locked into the swivel ring 41 and then locked into the fixing thin pin. The right knuckle 21 and the swivel ring 41 are fixed together with the thin pin so as to be able to position the axial and circumferential distance dimension coefficients position of sliding and moving relative to the lower and upper axis of the screw knuckle relative to the axial. The leaves of the hinges allow the hinge leaves to freely set the positioning angle, so that the swivel ring 41 and the right knuckle 21 can also limit and control the axial movement of the screw knuckle 40. A second flange 52 is provided on the connecting knuckle 50. The second flange 52 cooperates with the connecting knuckle 50 to allow the fixing base 60 to be fixed in the connecting knuckle. The portion of the fixing base 60 protrudes from the out of the connecting knuckle 50 passes through the screw through hole of the left knuckle 11 through a fixing screw 98, and then screwed into the fixing adjusting base 70 after being locked into the fixing base 60. At the same time, the fixing screw 98 is not used together with the left knuckle 11 and the fixing base 60 to lock the adjusting base 70, waiting for the adjusting base 70 to be adjusted and rotated to match the fixing base 60 and the second magnet 82 and the base of the cup body, so that the distance between the second magnet 82 and the first magnet 81 can be adjusted and shrink, so that the second magnet and the first magnet can be magnetically sucked together so as to be positioned in the connecting knuckle, so that the adjusting base can correspondingly adjust and set the positioning angle of the leaves of the hinge, so that the leaves of the hinge can be in a predetermined setting positioning angle, a required positioning angle between the predetermined positioning angles is self-positioned, and then start to the locked into the adjusting base 70 by the waiting fixing screw 98 to prevent the adjusting base 70 from loosening. The magnetic attraction between the stored energy of the first magnet 81 and the second magnet 82 by the magnetic attraction must be greater than the release of the energy storage spring force of the first spring 91 and the energy storage preload of the first spring 91. The protruding ring 32 can be combined with the annular protruding ring 32 to form the protruding ring 32. The auxiliary adjusting leaf positioning angle gasket 616 can form the cup bottom of the cup body 61 and can also be the gasket 85, and the auxiliary adjusting leaf positioning angle gasket 616 has an annular mounting groove 321 recessed in the outer ring circumferential direction. A sealing rubber ring 322 is bushed inside the mounting groove 321, and the sealing rubber ring 322 also protrudes out of the annular mounting groove 321 so that the auxiliary adjusting leaf positioning angle gasket 616 can be sealed and abutted in the connecting knuckle 50. The sealing rubber ring of the auxiliary adjusting leaf positioning angle gasket 616 can correspondingly cooperate with the adjusting base and the second magnet, so as to control and limit the adjusting base and the second magnet from shaking and walking in the connecting knuckle, the right leaf 22 of the right hinge 20 is more securely positioned at a predetermined angular position. The auxiliary adjusting leaf positioning angle gasket 616 is the cup bottom of the cup body 61, and the cup bottom of the cup body 61 is the gasket 85.

Embodiment 4

Figure 34:
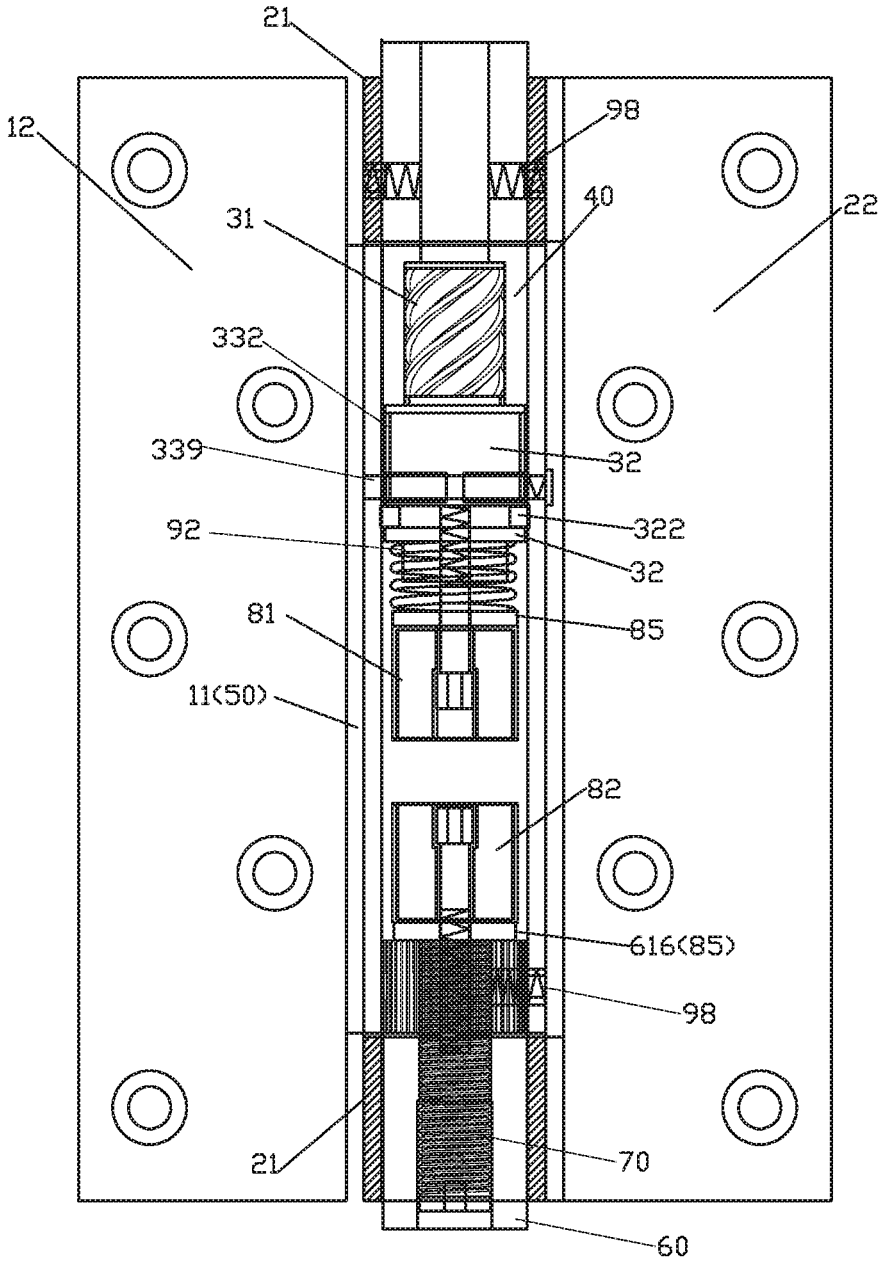
FIG. 34 is a schematic structural view of the hinge of the Embodiment 4.
Figure 35:
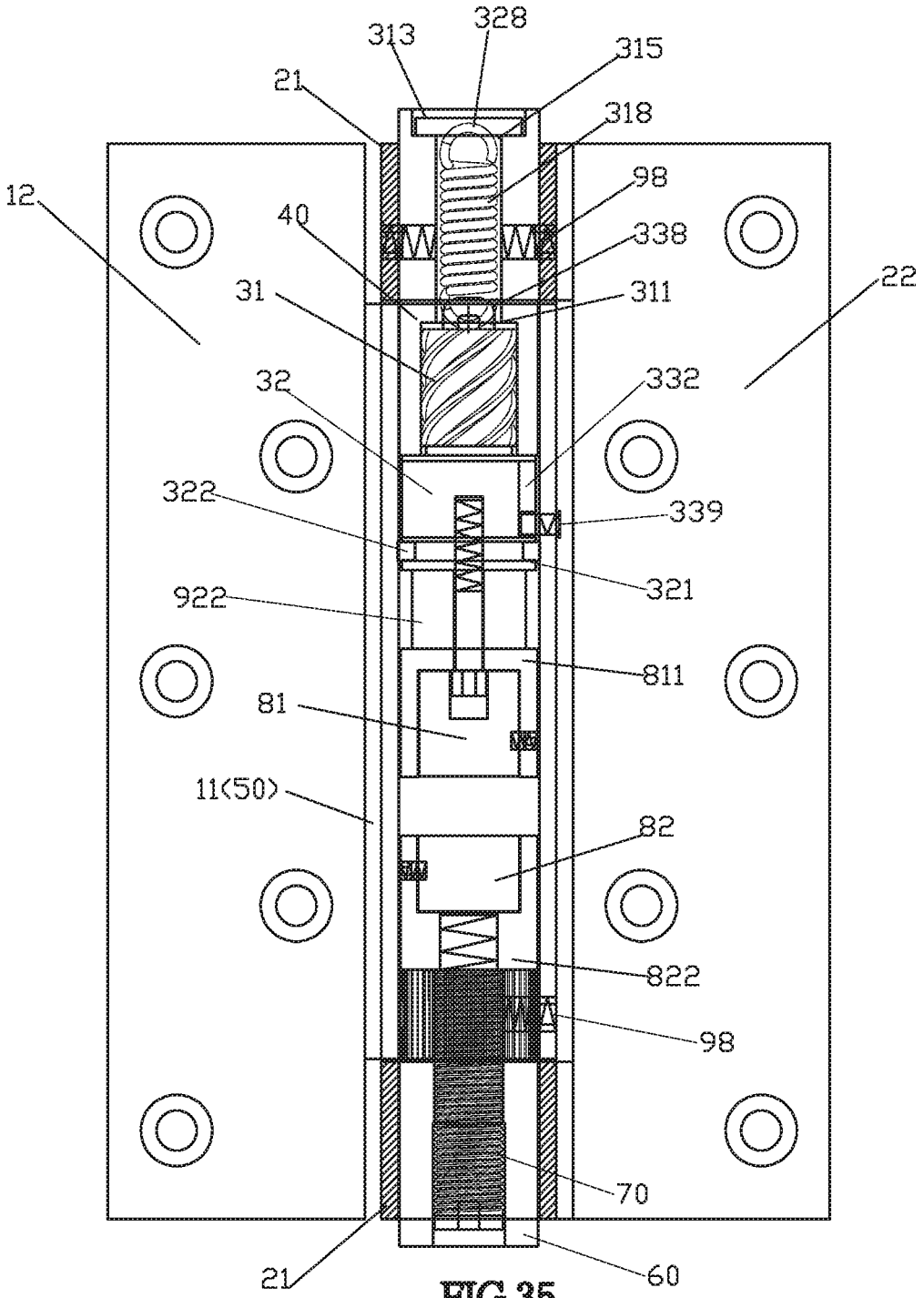
FIG. 35 is a schematic structural view of the hinge of the Embodiment 5.
Figure 36:
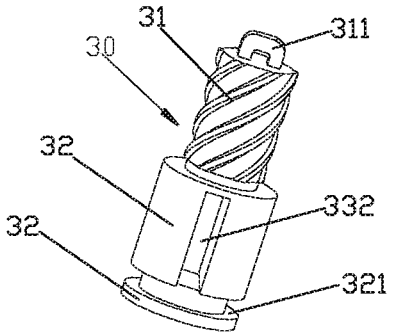
FIG. 36 is a three dimensional view of a screw pin pull ring of the Embodiment 5.
Figure 37:
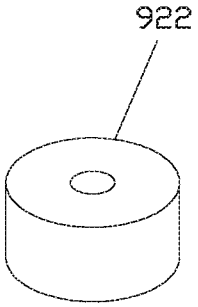
FIG. 37 is a three dimensional view of a rubber column of the Embodiment 5.
Figure 38:
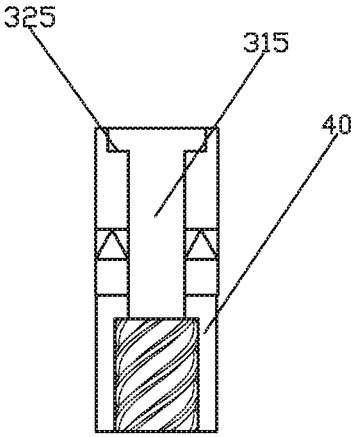
FIG. 38 is a schematic structural view of a screw knuckle spring through hole according to the Embodiment 5.
Figure 39:
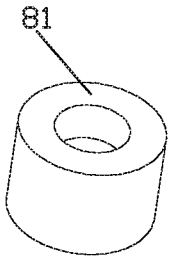
FIG. 39 is a three dimensional view of the first magnet according to the Embodiment 5.
Figure 40:
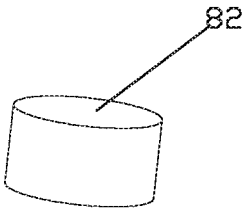
FIG. 40 illustrates a three dimensional view of the second magnet of the Embodiment 5.
Figure 41:
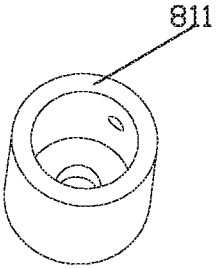
FIG. 41 is a three dimensional view of the first magnet cover of the Embodiment 5.
Figure 42:
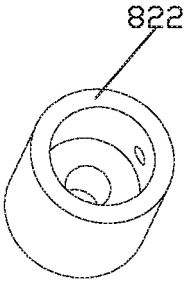
FIG. 42 is a three dimensional view of the second magnet cover of the Embodiment 5.

One difference from the embodiment 1 is that: Referring to FIG. 34, in a specific structure, the end of the screw pin 31 of the fixing pin 30 has a fixed protruding ring 32, and the protruding ring 32 is fixed with an annular protruding ring 32, and the annular protruding ring 32 is fixedly connected with a connecting pin 33, and the protruding ring 32 and the annular protruding ring 32 are fixedly connected together to form a protruding ring 32. The outer ring of the protruding ring 32 is concavely provided with a protruding ring sliding track groove through hole 332 in the circumferential direction, the ring protruding ring 32 is concavely provided with an annular mounting groove 321; wherein: the protruding ring sliding track through groove through hole 332 and can correspondingly fit the fixing sliding pin 339, so as to position and limit the fixing pin, the distance between the axial and the wheelbase of the screw knuckle sliding and moving axially downward and upward does not change, and the predetermined setting positioning angle can be set relative to match the leaf of the hinge. The fixing pin 30 further comprises a protruding ring 32 fixed at the end of the screw pin 31. The outer ring circumferential surface of the protruding ring 32 has a protruding ring sliding track penetrating groove through hole 332, and the protruding ring 32 also comprises a fixed annular ring 32, and the annular ring 32 is concavely provided with an annular mounting groove 321, and the annular mounting groove 321 is bushed with a sealing rubber ring 322. The sealing rubber ring 322 also protrudes out of the annular mounting groove 321, in order to enable the annular protruding ring 32 to be sealed and abutted in the connecting knuckle 50, the sealing rubber ring 322 and the annular protruding ring 32 are assembled to form the above-mentioned protruding ring 32. An annular groove 322 is recessed in the circumferential direction of the outer ring of the annular protruding ring 32, and an annular groove 321 of the annular protruding ring 32 is bushed with a sealing rubber ring 322, and the sealing rubber ring 322 also protrudes out of the mounting groove 321 can be sealed and abutted in the connection knuckle, so that the sealing rubber ring of the annular ring 32 can control and limit the sliding and movement of the screw pin in the connection knuckle under the axis relative to the knuckle. The distance between the axial direction and the circumferential distance does not change, and at the same time, it can also control and limit the sliding and moving of the screw pin in the knuckle under the relative screw knuckle along the axis and without shaking, and the sealing rubber ring 322 also plays a role of preventing the fixing pin from falling in the direction of the second magnet, the sealing rubber ring also has the function of assisting in reinforcing and reinforcing the stored energy of the second magnet and the enhanced release of the stored energy of the first magnet, so that the second magnet and the first magnet can be strongly positioned together in the connecting knuckle with strong magnetic attraction, and the self positioning strength of a certain position angle position of the leaf can be strengthened and reinforced and reinforced in the position angle between the predetermined position angle. The protruding ring slide track penetrating groove through hole 332 can constitute a protruding ring slide track groove 332. The sealing rubber ring 322 and the annular protruding ring 32 are assembled to form the above-mentioned protruding ring 32. The protruding ring 32 of the fixing pin 30 in the outer ring circumferentially concavely provided with a protruding ring sliding track penetrating groove through hole 332, and the fixing sliding pin 339 passes through the screw through hole of the left knuckle 11 and continues to pass through the protruding ring sliding track penetrating groove through hole 332 in the left knuckle 11 (the connecting knuckle 50) and continues to pass through the screw through hole of the left knuckle 11, so that the fixing sliding pin 339 is fixed on the circumferential wall of the inner and outer rings of the left knuckle 11, so that the fixed sliding pin 339 and the left knuckle 11 are fixed together, so that the fixing sliding pin 339 slidingly connected to the sliding knuckle 333 can pass through the protruding ring sliding track penetrating groove through hole 332, so that the fixing sliding pin 339 can match the protruding ring sliding track penetrating groove through hole 332 of the protruding ring 32 of the fixing pin 30, so as to control and position the axial and circumferential distance and dimensional coefficient position of the fixing pin which moves and slide up and down relative to the screw knuckle along the axis. The second spring 92 urges the right leaf 22 of the right hinge 20 to release after the right leaf 22 is opened to the 125 degree angular position which the right leaf 22 of the right hinge 20 is opened, and at the same time, the right leaf 22 of the right hinge 20 is opened to the predetermined position angle self position angle of 90 degrees between the 50 degree positioning angle to the 180 degree positioning angle in the preset positioning angle, and at the same time the annular protruding ring of the fixing pin 30 cooperates with the first magnet 81 to compress the second spring 92 from top to bottom, so that the second spring 92 is in the energy storage state of the second spring 92 with a high pressure. So that the energy storage state of the second spring 92 is changed, and the energy storage elastic force is released, so that A top ring protruding ring 32 of the energy storage elastic strength of one end of the second spring 92 can abut the top ring protruding ring 32 strongly, and an energy storage elastic force of the other end of the second spring 92 is pressed against the gasket 85 and the first magnet 81, so that the second spring 92 can make the right leaf 22 of the right hinge 20 to close back, so that the second spring 92 can reset the right leaf 22 of the right hinge 20 to a predetermined angular position of 90 degrees.

Embodiment 5

It differs from the embodiment 1 in that: please refer to FIG. 35 to FIG. 42. In a specific structure, wherein the screw pin 31 is fixedly connected with a screw pull ring 311, and the size of the hook pin 313 is matched with the hook pin placing step 325 of the upper end of the screw knuckle spring through hole 315. The hook pin 313 is placed on the hook pin step 325. Here, the screw knuckle 40 is provided with a screw knuckle through spring hole 315. The pull spring 318 is installed in the screw knuckle spring through hole 315; and both ends of the pull spring 318 are fixedly attached with a front pull hook 328 and a rear pull hook 338. The pull spring 318 has a front pull hook 328 hooked to the pull pin 313, and the pull spring 318 has a rear hook 338 hooked to the screw pull ring 311 so that the pull spring 318 can control the position of the screw pin 31 of the fixing pin to not vary in the distance between the lower and upper sliding axes of the screw pin 31 relative to the knuckle. The screw knuckle is screwed into the screw knuckle 40 through the screw through hole of the right shaft knuckle 21 through the fixing screw 98, so that the screw knuckle 40 is fixed in the right shaft knuckle 21 through the fixing screw 98. The portion of the screw knuckle 40 protruding out of the right knuckle 21 is rotatably connected in one end of the connecting knuckle 50. The right hinge 20 and the right knuckle 21 can also restrict and control the axial movement of the screw knuckle 40, relative to axial and circumferential distance dimension coefficient positions along the axis of sliding and moving along the axis of the screw pin, the leaf that can match the hinge are set to set the positioning angle, so that the hinge leaf can freely set the positioning angle; a protruding ring sliding rail groove 332 is recessed in an outer ring circumferential direction of the protruding ring 32, and the fixing sliding pin 339 passes through the screw through hole of the left knuckle 11 (the connecting knuckle 50) and abuts on the protruding ring sliding track groove 332, the fixing slide pin 339 is fixed on the circumferential shaft walls of the inner and outer rings of the left knuckle 11, and the fixing slide pin 339 and the left shaft knuckle 11 are fixedly connected together, so that the fixing slide pin 339 can match correspondingly the protruding ring sliding rail penetrating groove through hole 332 of the sliding pin ring 32 of the fixing pin 30, so as to control and position the fixing pin and the position and distance between the axial direction and the circumferential direction of the sliding and moving of the screw knuckle along the lower and the upper axis of the screw knuckle, and relatively to match the leaf of the hinge to predetermine to set the positioning angle, so that the positioning angle of the leaf of the hinge can be from 50 degrees positioning angle position to 180 degrees positioning angle position. The first magnet cover 811 through the fixing screw 98 pass through the side circumferential through hole of the first magnet cover 811 and then is screwed into the first magnet 81, so that the first magnet cover 811 and the first magnet 81 are fixed together. The first magnet cover 811 is made of epoxy or any kind of glue, so that the first magnet 81 and the first magnet cover 811 are fixed together. The first screw 83 passes through the through hole of the first magnet cover 811, and passes the rubber post 922 and then is screwed to the annular ring 32, so that the first magnet cover 811 and the first magnet 81 and the rubber post 922 and annular rings 32 are connected together. The second magnet cover 822 is connected to the second magnet 82 via a fixing screw 98 passing through the side circumferential hole of the second magnet cover 822 so that the second magnet cover 822 and the second magnet 82 are fixed together. The second magnet cover 822 is made of epoxy or any kind of glue so that the second magnet 82 and the second magnet cover 822 are fixed together. The adjusting base 70 is screwed into the screw through hole of the second magnet cover 822 so that the second magnet cover 822 and the adjusting base 70 are fixed together. The adjusting base 70 is adjusted to rotate so as to be able to correspond to the fitting base 60 and the second magnet 82 and the second magnet cover 822, so as to be able to adjust and shrink the distance between the second magnet 82 and the first magnet 81, to match the hinge leaf to adjust the predetermined angle position self-positioning The rubber column 922 urges the right leaf 22 of the right hinge 20 to be opened to an angle of 125 degrees when the right leaf 22 of the hinge is opened, so that the right leaf 22 of the hinge is opened to over the predetermined angle self-positioning angle position of 90 degrees between the 180 degree positioning angle from 50 degrees position angle. At the same time, the rubber column 922 is compressed by the high-strength high-pressure from top to bottom of the annular protruding ring 32 of the fixing pin 30, so that the energy storage elastic force state of the rubber column 922 changes, so that the energy storage elastic force of the rubber column 922 is released, so that the energy-storing elastic force of one end of the rubber column 922 can strongly abut the annular protruding ring 32, and the energy storage elastic force of the other end of the rubber column 922 can be strongly pressed against the first magnet cover 811, so that the rubber column 922 can make relatively the right leaf 22 of the right hinge 20 close back, so that the rubber column 922 can reset the right leaf 22 of the right hinge 20 to a predetermined angle position of 90 degrees for self-positioning.

The above description is only the preferred embodiment of the present invention, so the scope of implementation of the present invention cannot be limited accordingly. That is, the equivalent changes and modifications made according to the scope of the patent of the present invention and the content of the description shall still belong to the scope of the present invention.

INDUSTRIAL APPLICABILITY

The invention provides an adjustable-angle positioning and self-closing hinge comprising two hinges, a fixing pin, a screw knuckle, a screw ring, a fixing base and an adjusting base. The close fitting between various portions can realize self-positioning at a predetermined angle and self-closing at another predetermined angle. The invention can also adjust the predetermined angle of self-positioning. The invention has a wide range of application prospects and good industrial applicability.

The invention claimed is:

1. An adjustable-angle positioning and self-closing hinge, comprising: a first hinge leaf and a second hinge leaf; a fixing pin; and a screw knuckle; the first hinge leaf and the second hinge leaf being pivotable in relation to each other, each of the first hinge leaf and the second hinge leaf comprising a knuckle and a leaf fixed on an outside of the knuckle, the fixing pin having a screw pin, wherein the adjustable-angle positioning and self-closing hinge further comprises a fixing base, an adjusting base and a screw ring, wherein the screw knuckle is fixed in the knuckle of one of the first and the second hinge leaves, the fixing base is fixed in the knuckle of the hinge, and the screw knuckle is separate from the fixing base, the adjustable-angle positioning and self-closing hinge further comprises a first magnet, a second magnet, a first spring, a cup body, and a second spring;

wherein the fixing pin, the screw ring, the first magnet, the second magnet, the first spring, the cup body, the second spring and the adjusting base are arranged between the screw knuckle and the fixing base in the knuckles of the first and the second hinge leaves, the screw pin is screwed into the screw knuckle, and the first spring is abutted between the fixing pin and a front end surface of the cup body, the first magnet is movable with the fixing pin, and a first end of the second spring abuts against the fixing base, an opposite second end of the second spring abuts against the second magnet, the second magnet is movable relative to the fixing base, the first magnet and the second magnet are magnetically attracted, the adjusting base is rotated so as to fit to the second magnet, the fixing base and a bottom of the cup body, so that a distance between the second magnet and the fixing base is adjusted and a distance between the second magnet and the first magnet is adjusted.

2. The adjustable-angle positioning and self-closing hinge according to claim 1, wherein the fixing base is fixed in the knuckle of the second hinge leaf.

3. The adjustable-angle positioning and self-closing hinge according to claim 2, wherein the adjustable-angle positioning and self-closing hinge further comprises a connecting knuckle, the fixing pin is slidably and movably connected in the connecting knuckle, and the screw knuckle is connected in the connection knuckle in a rotatable and non-sliding manner, the first magnet, the second magnet, the first spring and the second spring are disposed in the connecting knuckle; the first hinge leaf and the portion of the screw knuckle extending out of the connecting knuckle are fixedly connected, the second hinge leaf and the portion of the fixing base extending out of the connecting knuckle are fixedly connected.

4. The adjustable-angle positioning and self-closing hinge according to claim 1, wherein the adjustable-angle positioning and self-closing hinge further comprises a first screw and a second screw, the first screw and the second screw have a smooth pin section and a threaded section located at an end, the smooth pin section of the first screw passes through the first magnet and the threaded section is screwed on the fixing pin, the screw head of the first screw is supported on the first magnet, and the smooth pin section of the second screw passes through the second magnet, and the thread section is screwed into the adjusting base, and the screw head of the second screw is supported on the second magnet.

* * * * *